US008631949B2

(12) United States Patent
Roodenburg et al.

(10) Patent No.: US 8,631,949 B2
(45) Date of Patent: Jan. 21, 2014

(54) TUBULARS STORAGE DEVICE

(75) Inventors: Joop Roodenburg, Delft (NL); Michal Horak, Rotterdam (NL); Harmen Kromdijk, Vlaardingen (NL)

(73) Assignee: Itrec B.V., Schiedam (NL)

( * ) Notice: Subject to any disclaimer, the term of this patent is extended or adjusted under 35 U.S.C. 154(b) by 785 days.

(21) Appl. No.: 12/808,340

(22) PCT Filed: Nov. 26, 2008

(86) PCT No.: PCT/NL2008/000259
§ 371 (c)(1),
(2), (4) Date: Sep. 28, 2010

(87) PCT Pub. No.: WO2009/082197
PCT Pub. Date: Jul. 2, 2009

(65) Prior Publication Data

US 2011/0005162 A1 Jan. 13, 2011

Related U.S. Application Data

(60) Provisional application No. 61/008,290, filed on Dec. 20, 2007.

(51) Int. Cl.
*E04H 12/00* (2006.01)
*E21B 19/14* (2006.01)

(52) U.S. Cl.
USPC ..... 211/60.1; 175/85

(58) Field of Classification Search
USPC ..... 211/60.1; 414/22.63; 175/85
See application file for complete search history.

(56) References Cited

U.S. PATENT DOCUMENTS

| | | | | |
|---|---|---|---|---|
| 3,501,017 | A * | 3/1970 | Johnson et al. | 211/70.4 |
| 3,768,663 | A | 10/1973 | Turner, Jr. et al. | |
| 3,799,364 | A | 3/1974 | Kelly et al. | |
| 3,895,677 | A | 7/1975 | Bokenkamp | |
| 3,965,994 | A * | 6/1976 | Hilding | 175/52 |
| 7,083,007 | B2 * | 8/2006 | Herst | 175/52 |

FOREIGN PATENT DOCUMENTS

| | | |
|---|---|---|
| GB | 1 588 849 | 4/1981 |
| WO | WO 2005/061839 A1 | 7/2005 |

* cited by examiner

*Primary Examiner* — Katherine Mitchell
*Assistant Examiner* — Justin Rephann
(74) *Attorney, Agent, or Firm* — Birch, Stewart, Kolasch & Birch, LLP

(57) ABSTRACT

A tubulars storage device for storing a plurality of tubulars which has a slot forming a path of displacement for tubulars allowing to place tubulars at respective storage positions distributed along the slot as well as removal of said tubulars from the slot. The device includes a rotary latch members shaft, which is mounted substantially parallel to the slot, and a drive connected to the rotary latch members shaft, said drive being adapted to effect controlled angular rotation of the latch members shaft. A plurality of latch members are mounted on the latch members shaft so as to rotate with the latch members shaft and are arranged at spaced apart locations along the latch members shaft.

20 Claims, 12 Drawing Sheets

TUBULARS STORAGE DEVICE

In the Specification:

This application is the National Phase of PCT/NL2008/000259 filed on Nov. 26, 2008, which claims priority under 35 U.S.C. 119(e) to U.S. Provisional Application No. 61/008,290 filed on Dec. 20, 2007 all of which are hereby expressly incorporated by reference into the present application.

FIELD OF THE INVENTION

The present invention relates to a tubulars storage device for storing a plurality of tubulars. In the oil and gas well drilling industry numerous types of piping, referred to generally as "tubulars", are used. Tubulars include drill pipes, casing pipes, and other connectable (e.g. by screwthread) oil and gas well structures. Long "strings" of joined tubulars, e.g. drill strings or casing stands, are typically used to drill a wellbore and to prevent collapse of the wellbore after drilling.

A common tubular storage device for tubulars in the oil and gas industry is referred to as "a fingerboard". Other known storage devices for tubulars in the oil and gas industry are referred to as "setbacks", "setback drums", "pipe racks", "pipe rackers", etc.

BACKGROUND OF THE INVENTION

Tubulars storage devices, such as fingerboards, typically include a slot delimiting structure, e.g. spaced apart finger members, that define a slot capable of receiving a plurality of tubulars, e.g. drill strings. Each tubular is typically individually secured at a storage position along the slot by a corresponding latch member, which is movable between a locked and an unlocked position.

In some prior art tubulars storage devices, the latches are manually moved between the locked and unlocked positions by worker who walks across the fingers to manually move the latches, e.g. by kicking, to the desired locked or unlocked position. As the finger members are often mounted at a great height (in some instances 90 feet above the drilling floor or taller) this type of manual operation of the latches by the worker is dangerous.

To overcome this dangerous situation tubular storage devices have been developed that include "automated latches" which are controlled from a remote location.

In U.S. Pat. No. 3,768,663 and U.S. Pat. No. 3,799,364 tubular storage device for use in a drilling rig are shown, wherein pivotal latch fingers are placed along the storage slot. The fingers are each connected to a hydraulic cylinder in order to selectively bring the latch into a locked position, wherein the finger extends into the path of displacement of the tubulars formed by the slot, and an unlocked position, wherein the finger is out of said path of displacement.

In WO2005/061839 are a more recent tubular storage device is shown. This device includes a so-called row controller that is connected to each of the latches for individually and sequentially moving the latches between the locked and the unlocked position.

OBJECT OF THE INVENTION

It is an object of this invention to provide a tubular storage device that is better suited to the needs of the oil and gas industry than prior art devices.

In particular it is an object to provide a device with a high degree of safety, reliable operation.

It is also an object to provide a device that requires little maintenance.

A further object is to provide a device that is able to adapt to the diameter of the tubulars, e.g. to be able to receive different diameter tubulars.

SUMMARY OF THE INVENTION

The present invention provides a tubulars storage device for storing a plurality of tubulars.

The tubulars storage device comprises a slot, e.g. defined by spaced apart finger members, having an opening at a front end thereof, said slot forming a path of displacement for tubulars allowing to place tubulars at respective storage positions distributed along the slot and/or removal of said tubulars from the slot.

The tubular storage device further includes a rotary latch members shaft, which is mounted substantially parallel to the slot, and a drive that is connected to the rotary latch members shaft, said drive being adapted to effect controlled angular rotation of the latch members shaft.

On the latch members shaft a plurality of latch members are mounted so as to rotate with the latch members shaft. These latch members are arranged at spaced apart locations along the latch members shaft.

The plurality of latch members includes a front latch member having a smallest angular extension and a rear latch member having a largest angular extension as well as one or more intermediate latch members between said front and rear latch member. Each of said intermediate latch members has a greater angular extension than the preceding latch member on the latch members shaft.

The drive is adapted to selectively bring the rotary latch members shaft in one of a number of distinct angular positions, said number corresponding to the number of latch members on the latch members shaft plus one.

The angular extension of each of the latch members on the latch members shaft is chosen such that:

in a first angular position of the rotary latch members shaft all latch members on the shaft extend in the path of displacement of tubulars, thereby prohibiting displacement of the tubulars along the slot, in a second angular position only the front latch member is located out of said path of displacement thereby effectively unlocking the front latch member and allowing the passage of a tubular, in each subsequent angular position said front latch member remains located out of said path of displacement of the tubulars, and thus effectively unlocked, and a successive latch member is also located out of said path of displacement, and thus effectively unlocked, and in a final angular position of the shaft all latch members are located out of the path of displacement of the tubulars and thus effectively unlocked.

The invention further relates to an oil and gas well drilling structure, e.g. a drilling derrick, equipped with such a tubulars storage device. It will be appreciated that the drilling structure can be a land based structure (e.g. a transportable land based structure), an offshore structure (e.g. a platform), or a drilling vessel mounted structure.

DETAILED DESCRIPTION OF PREFERRED EMBODIMENTS

Figure 1:
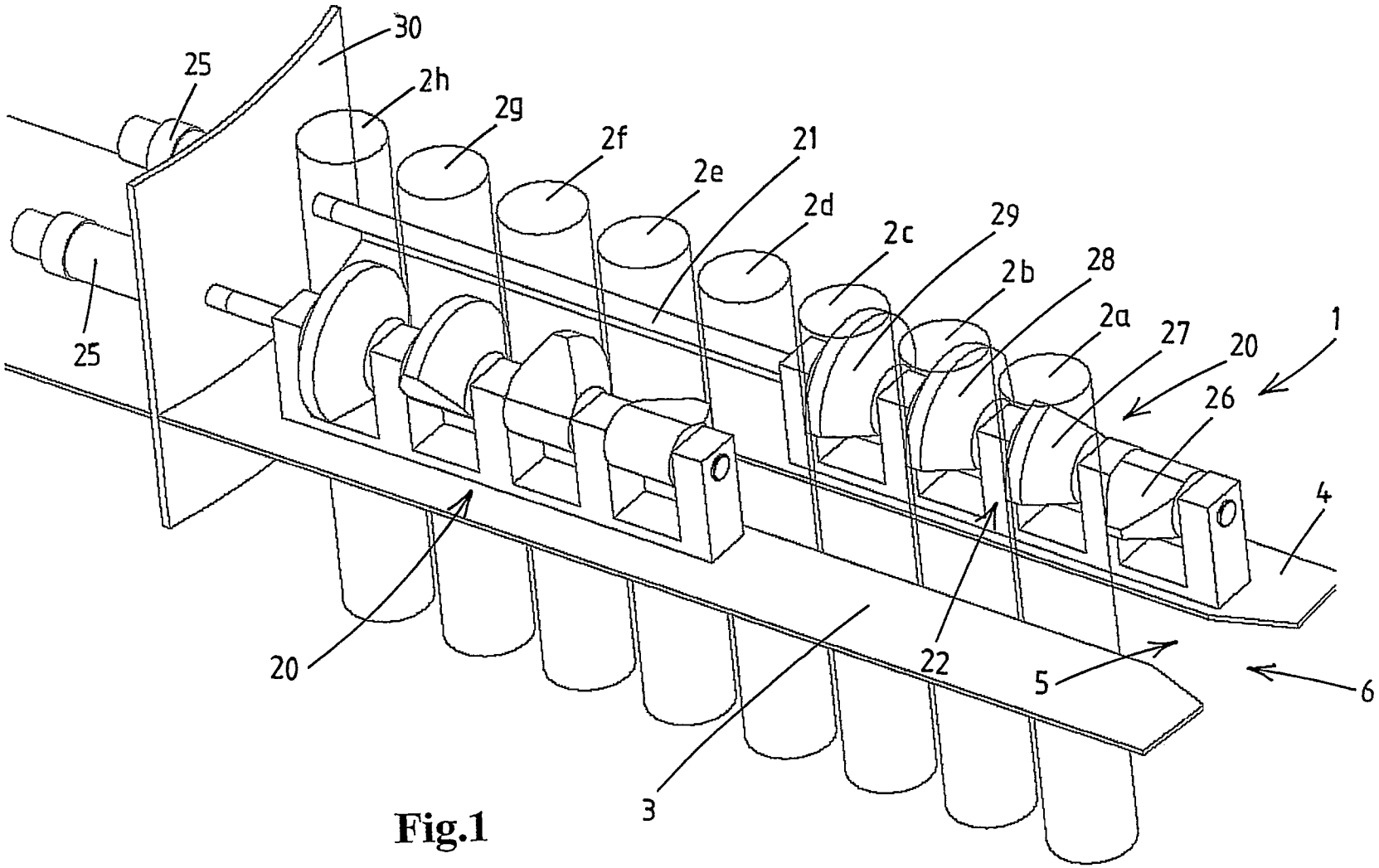
FIG. 1 shows an example of a tubulars storage device according to the invention.

Referring to FIGS. 1-5 a preferred embodiment of a tubulars storage device 1 according to the invention for storing a plurality of tubulars 2*a-h* will be explained in detail. As mentioned above the term "tubulars" is a known term in the oil and gas industry and is intended to cover all tubular products used for well drilling and other well related activities.

In the examples shown herein it is assumed that the tubulars 2*a-h* are stored in vertical position, but the storage device according to the invention is also suited for other orientation of the tubulars, e.g. horizontal storage.

The tubulars 2*a-h* may be suspended in vertical position from the storage device, e.g. by each tubular having a larger diameter head (e.g. a connector head) which engages on the storage device, e.g. on suspension members mounted at a higher level than the finger members 3,4.

In this example it is assumed that the lower ends of the vertically arranged tubulars are resting on a support surface (not shown) of the tubulars storage device, e.g. having a position member engaging the lower end of each tubular to hold it in position.

In general the storage device 1 include a pair of spaced apart finger members 3, 4 (e.g. plate members) forming there between a slot 5 having an opening 6 at a front end thereof and having a closed end 7 at the rear of the slot 5.

The slot 5 forms a path of displacement for the tubulars 2*a-h* allowing to place tubulars at respective storage positions distributed along the slot 5 as well as removal of said tubulars from the slot 5.

In this example the slot 5 is configured to receive eight tubulars 2*a-h*. For example the tubulars are pre-assembled multiple pipe joints (e.g. triples or quads) as often found in the oil and gas drilling industry.

In this example a latch mechanism 20 is shown for each group of four tubulars. As these mechanisms 20 are basically similar in design and operation only one of them will be described in more detail.

The latch mechanism 20 includes a rotary latch members shaft 21, which is mounted on a finger member 4 substantially parallel to the slot 5.

A drive 25, here a suitable electric motor drive 25, is connected to the rotary latch members shaft 21, said drive 25 being adapted to effect controlled angular rotation of the latch members shaft 21.

A plurality of latch members 26-29, here four latch members, are mounted on the latch members shaft 21 so as to rotate with the latch members shaft 21 and are arranged at spaced apart locations along the latch members shaft 21.

The shaft 21 here is held in a shaft support structure 22 which is in this example mounted on the finger member 4, as is preferred the shaft support structure supporting the shaft between neighbouring latch members 26-29.

This group of latch members 26-29 includes a front latch member 26 which is arranged nearest to the front opening 6 of the latches within the group 26-29. This front latch member 26 has a smallest angular extension, whereas the rear latch member 29 has a largest angular extension. It will be appreciated that the angular extension is considered to be the effective extension of the member in angular direction about shaft 21.

Between said front latch member 26 and rear latch member 29 here two more latch members, referred to as intermediate latch members 27, 28 are placed on the shaft 21. These intermediate latch member 27, 28 each have a greater angular extension than the preceding latch member on the latch members shaft 21. So the angular extension of the latch member becomes greater as one goes further to the rear of the group of latch members on the shaft 21.

The drive 25 is adapted to selectively bring the rotary latch members shaft 21 in one of a number of distinct angular positions, said number corresponding to the number of latch members on the latch members shaft plus one, so in five positions in this example. Of course the drive 25 could be configured to provide further distinct angular positions of the shaft 21 for other purposes when desired.

The angular extension of each of the latch members 26-29 on the latch members shaft 21 is chosen such that:

in a first angular position of the rotary latch members shaft 21 all latch members 26-29 on the shaft extend in the path of displacement of tubulars, thereby prohibiting displacement of the tubulars along the slot (this is shown in FIGS. 1-4), in a second angular position only the front latch member 26 is located out of said path of displacement thereby effectively unlocking the front latch member 26 and allowing the passage of a tubular (in this example the tubular 2*a* can then be removed from the storage device, whereas all others are retained), in a subsequent angular position said front latch member 26 remains located out of said path of displacement of the tubulars, and thus effectively unlocked, and the successive latch member (here member 27) is also located out of said path of displacement, and thus effectively unlocked, (thus allowing the removal of tubular 2*b*), in a further subsequent angular position the latch members 26, 27 remain out of said path of displacement and now also the latch member 28 is moved out of said path (thus unlocking the tubular 2*c*), and in a final angular position of the shaft 21 all latch members 26-29 are located out of the path of displacement of the tubulars and thus effectively unlocked (so that also tubular 2*d* can be removed from the slot).

It will be appreciated that by simple step-by-step rotation of the shaft 21 the latches 26-29 are successively unlocked, thus allowing a further tubular to be removed from the storage device.

The effective angular extension of each latch member 26-29 can easily be configured by the skilled person, e.g. depending on the number of latch members on the shaft. A practical number of latch members on a shaft 21 is four or five, but other numbers are also possible.

It will be appreciated that further rotation of the shaft 21 from the "final angular position" allows to bring the shaft 21 in its first position again so that all latch members 26-29 are locked again.

A latch member 26-29, at least the portion thereof which effectively extends into the path of the tubulars, is preferably embodied as a solid metal body, e.g. shaped as a segment of a disc. In this example—as is preferred—conical side portions are integral with said central segment in order to enhance stability of the latch member.

Other embodiments of the latch members 26-29 are also envisaged, e.g. each latch member having two pins defining the outer angular extremities of the latch member (possibly with a bridge member extending between the pins).

As can be seen in FIG. 1 the drive(s) 25 can be placed in a protective housing 30 or behind a protective shield, preferably further rearward than the rear of the slot 5.

The drives 25 could be of any suitable design, e.g. including a hydraulic actuator.

It is noted here that the slot 5 can be formed by a finger member delimiting one side of the slot, the opposite side of the slot being formed by the shaft 21 with latch members so without a finger member at said side of the slot.

Also a slot 5 could be delimited by two spaced apart shafts 21 with latch members in the absence of finger members or the like.

It is noted that in an alternative embodiment of the storage device (not shown) the slot is also open at the rear of the slot. This could e.g be used to empty the storage device at one end of the slot and filling the storage device from the other end of the slot.

In FIGS. 5*a-d* a portion of a setback drum member 40 is shown in view from above, having multiple slots 5 for storage of tubulars, each having an opening 6 at the outer contour of the drum member 40.

Figure 2:
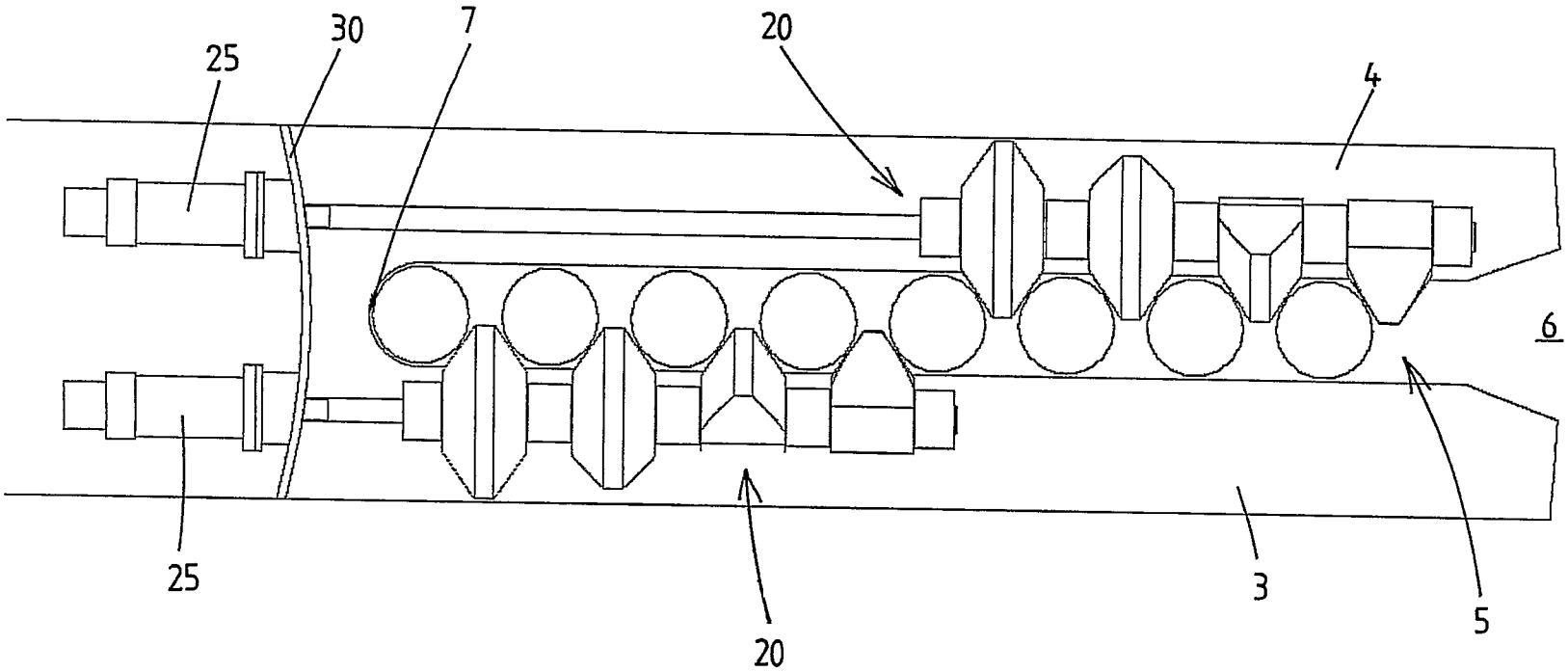
FIG. 2 shows the device of FIG. 1 from above.
Figure 3:
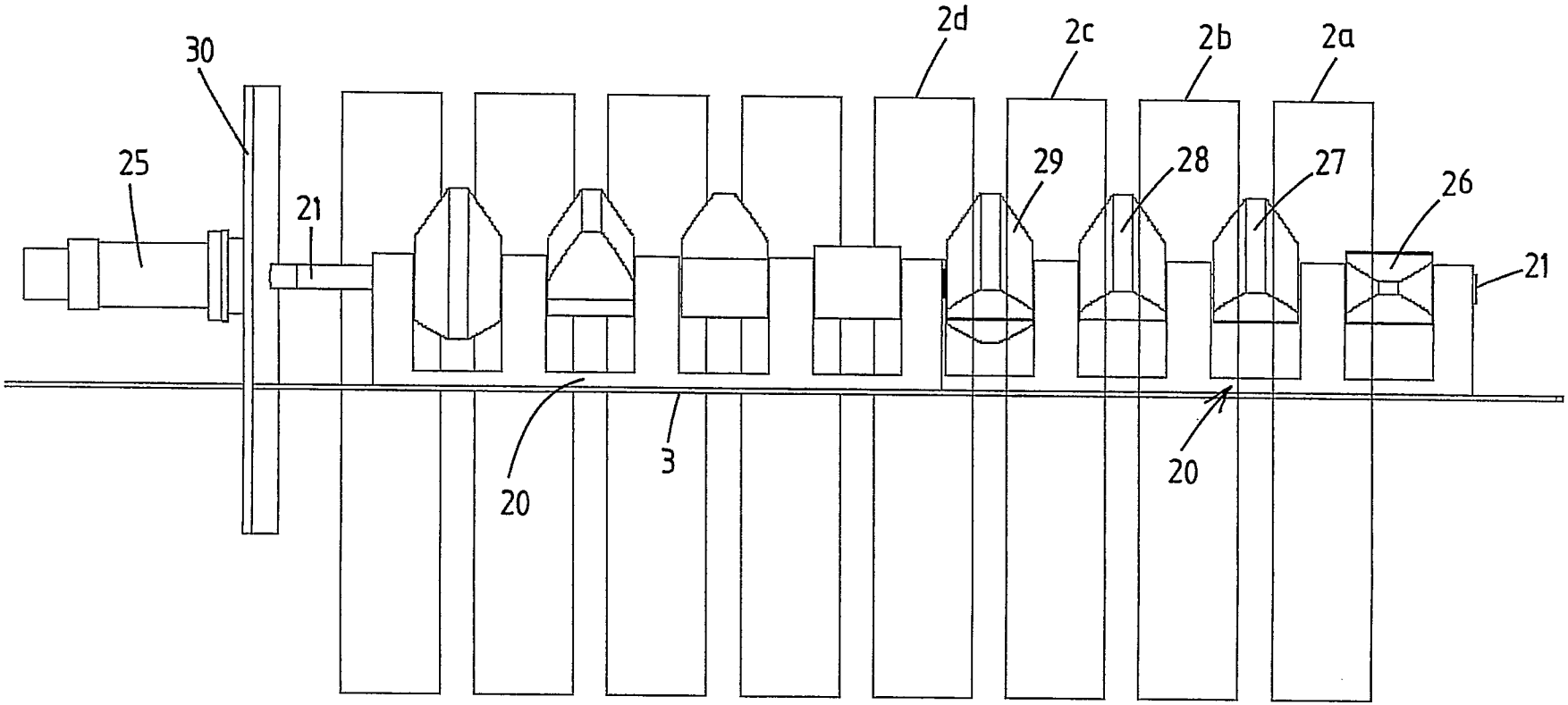
FIG. 3 shows the device of FIG. 1 in side view.
Figure 4:
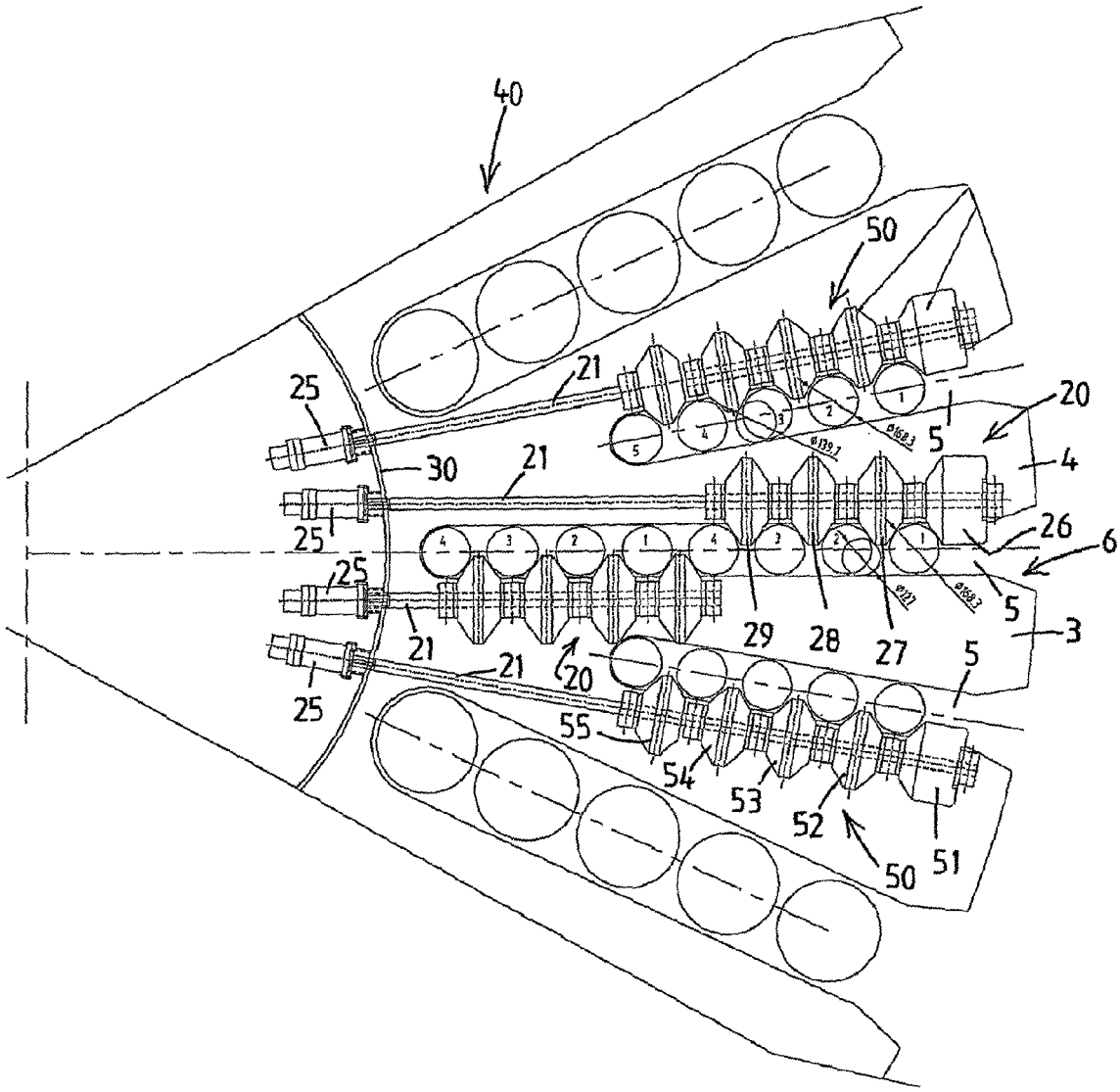
FIG. 4 shows a portion of a setback drum from above including the device of FIG. 1 and two tubular storage devices of an alternative embodiment according to the invention.
Figure 5A:
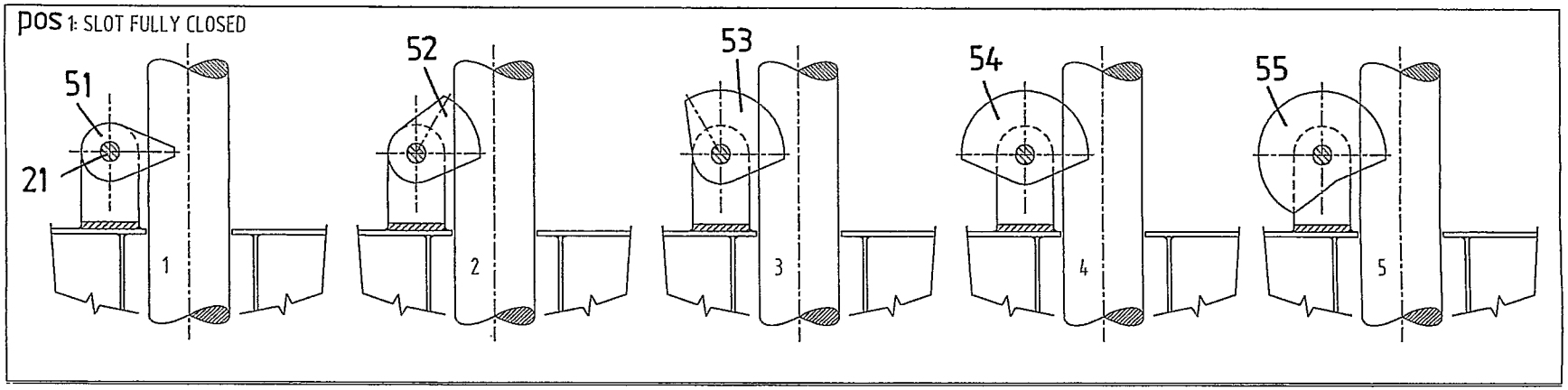
FIGS. 5*a-d* show an illustration of the position of each latch member of said alternative embodiment for several angular positions of the latch members shaft
Figure 5B:
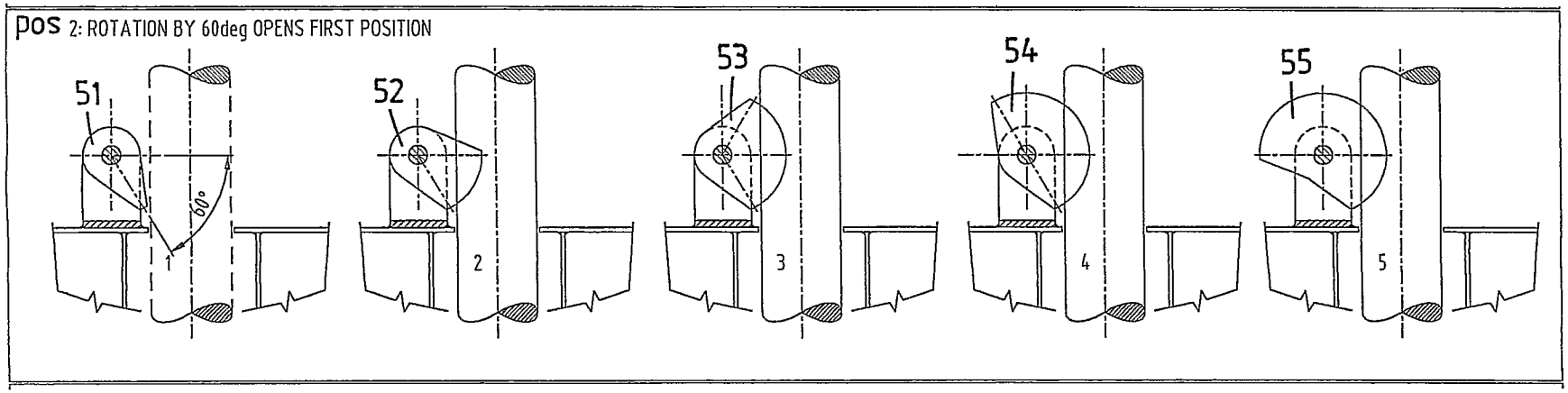
Figure 5C:
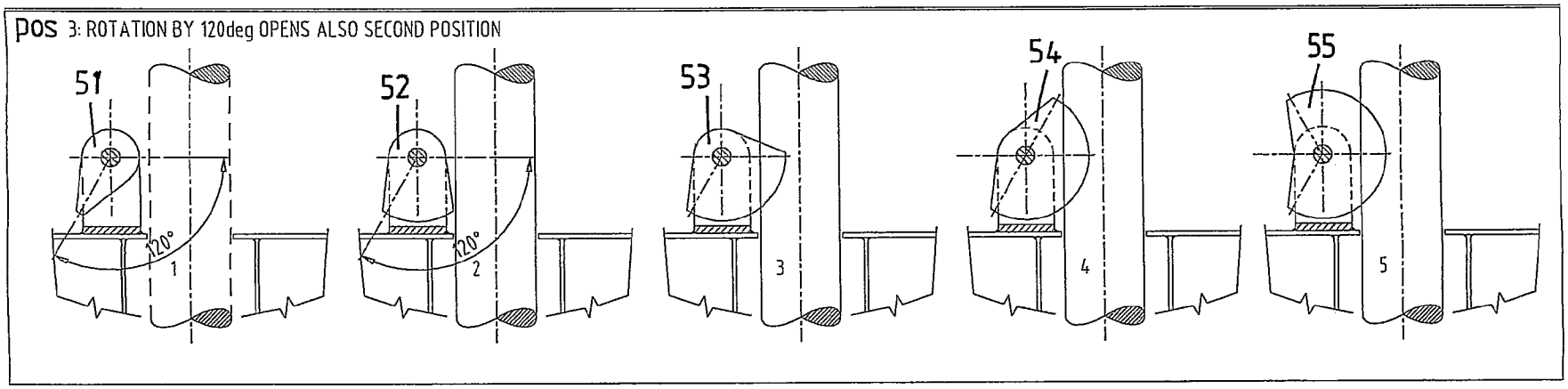
Figure 5D:
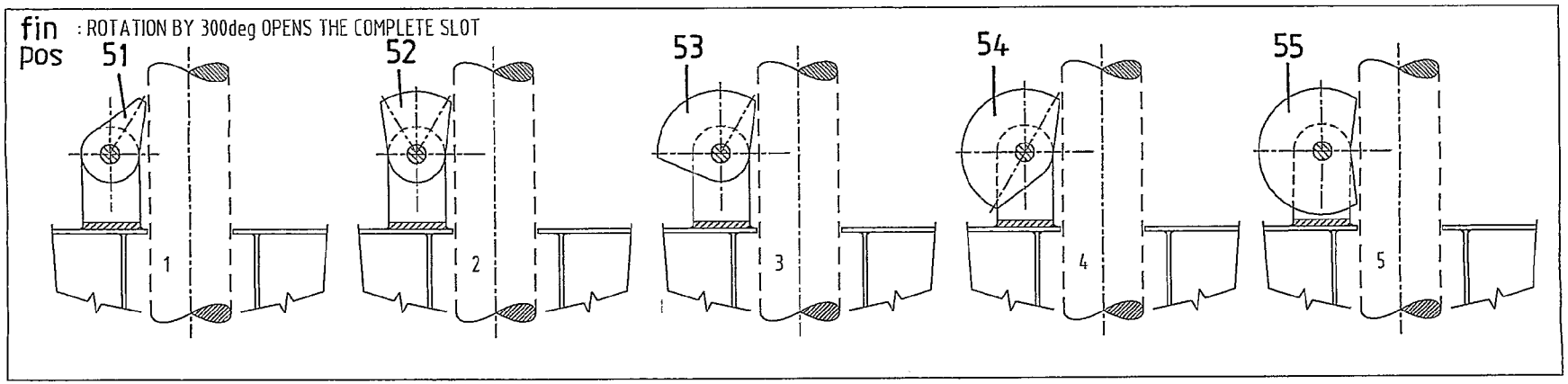
Figure 6:
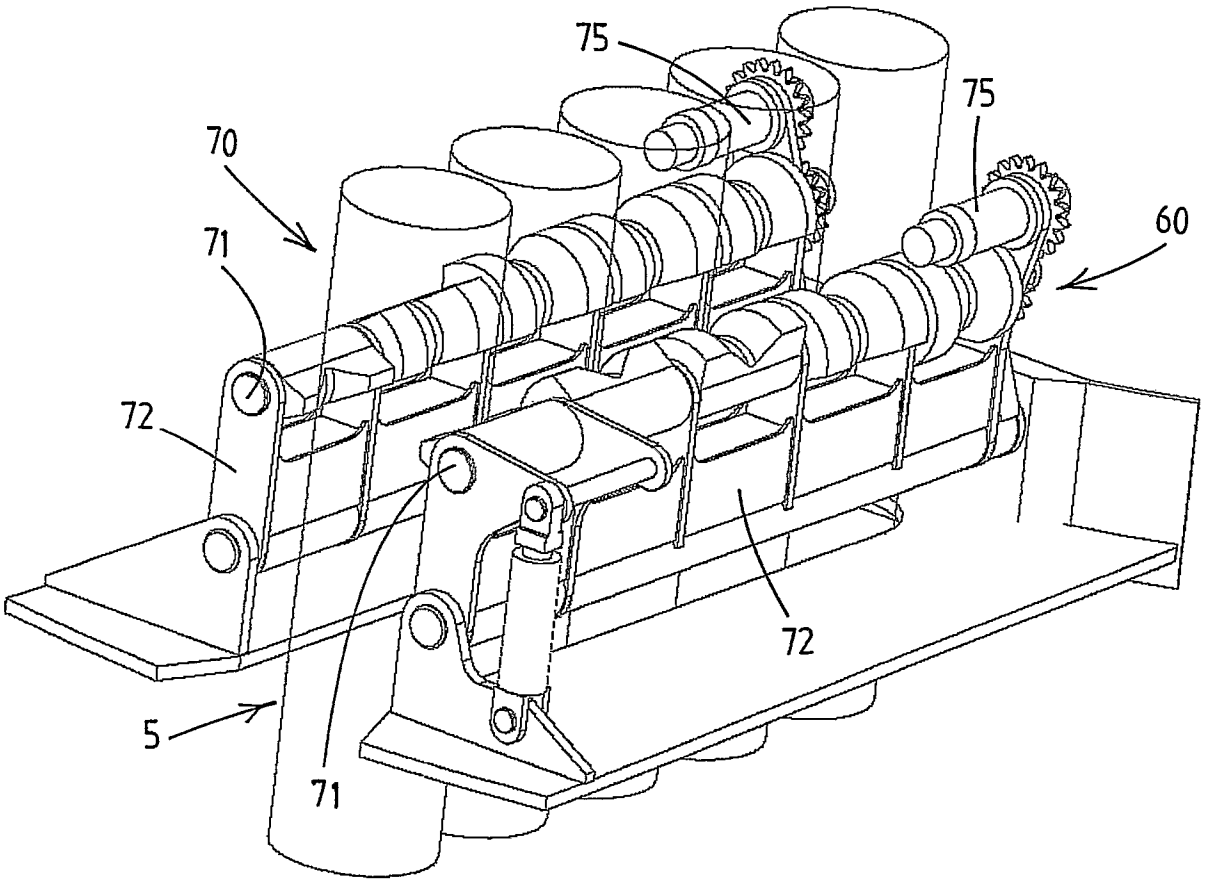
FIG. 6 shows yet another embodiment of a tubulars storage device according to the invention.
Figure 7:
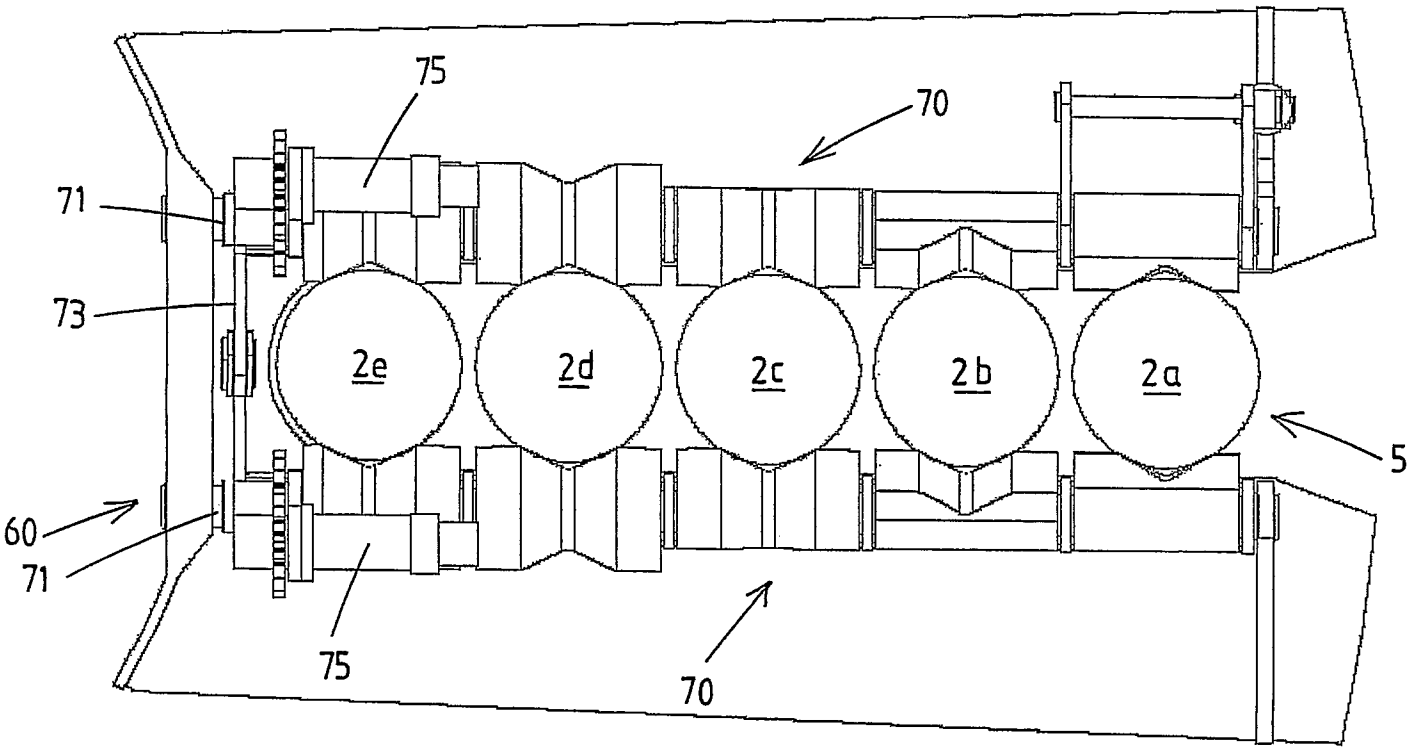
FIG. 7 shows the device of FIG. 6 in view from above.
Figure 8:
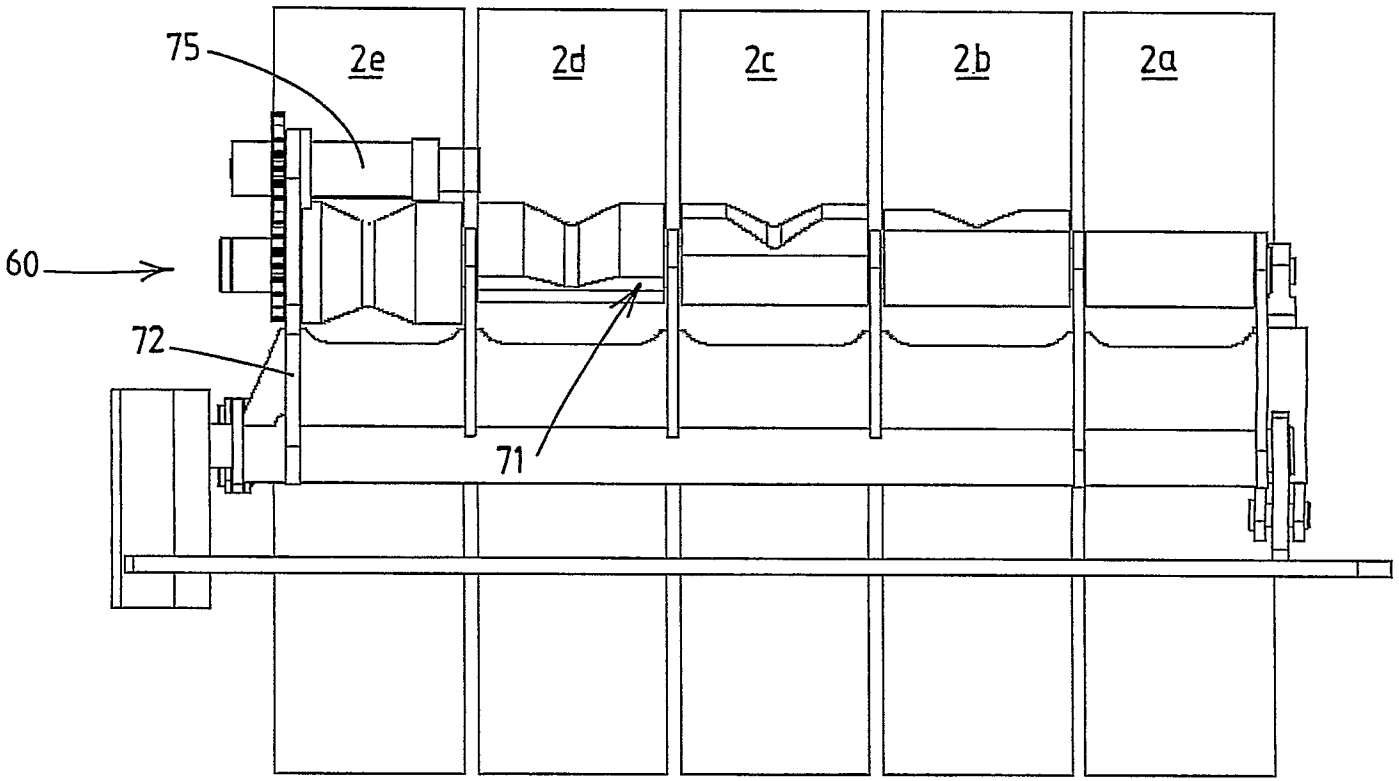
FIG. 8 shows the device of FIG. 6 in side view.
Figure 9:
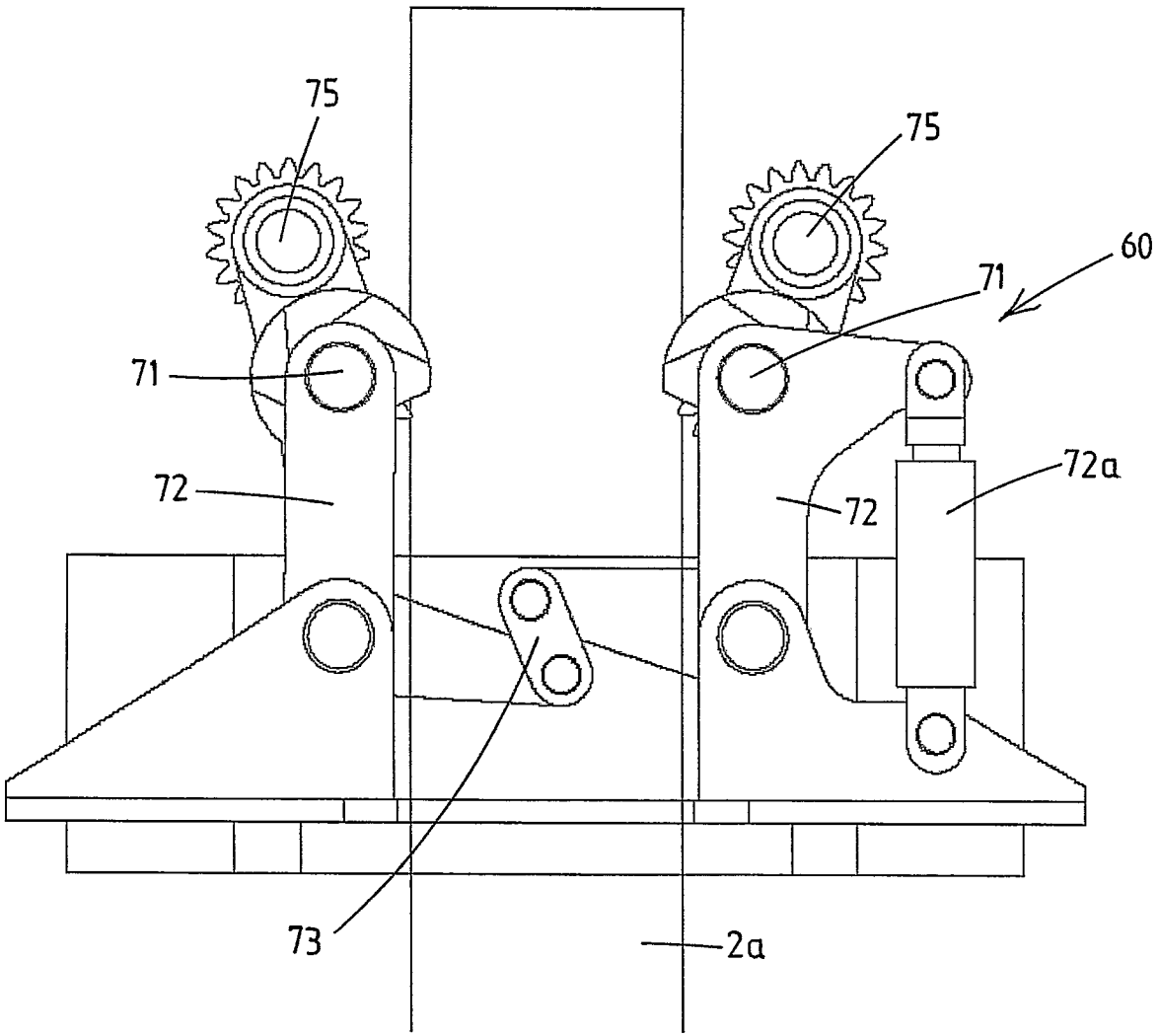
FIG. 9 shows the device of FIG. 6 in front view.

In this member 40 the storage device 1 with latch mechanism 20 as shown in FIGS. 1-3 is present, as well as two further storage devices with latch mechanism 50 according to the invention.

These storage devices with latch mechanism 50 are each placed along a slot 5 suited for receipt of five tubulars, and so each include five latch members 51-55. These members 51-55 are mounted on a rotary shaft 21, which is rotated by drive 25 in basically the same manner as explained with referral to FIGS. 1-3.

To illustrate this operation of the latch mechanism 50 referral is now made to FIG. 5.

In the block "pos 1 slot fully closed" the position of the latch members 51-55 is depicted corresponding to the first angular position of the shaft 21. As can be seen starting from the front latch member 51 towards the rear latch member 55 the angular extension of the latch member is stepwise increased, so that the latch member 51 is the smallest and latch member 55 the largest in said respect.

In the block "pos 2 rotation by 120 deg opens first position" the second angular position of shaft 21 is shown, wherein the front latch member 51 is in unlocked position. The other latch members 52-55 also have been rotated, but each still extend with a portion thereof into the path of the tubulars. Thereby on the tubular 1 can be removed from the slot 5, the others 2-5 are still retained.

In the block "pos 3 rotation by 120 deg opens also second position" the third angular position of the shaft 21 is shown. In this position both the front latch member 51 and the neighbouring latch member 52 are in unlocked position, so that now tubular 2 can be removed. The other latch members 53-55 still have a portion extending such that the associated tubular is blocked from motion towards the opening 6 of the slot 5.

It will be appreciated that by further stepwise rotation finally the final position of the shaft 21 can be reached, which is shown in block "fin pos rotation by 300 deg opens the complete slot". Now all latch members on the shaft 21 find themselves outside of the path of the tubulars, so that also tubular 5 is now released. Obviously a slot can be filled with tubulars starting from this position of the shaft 21 and then rotation the shaft in opposite direction so that one by one the latch members are brought in locked position as a further tubular is placed in the slot 5.

FIGS. 6-9 show an alternative tubulars storage device 60 according to the invention.

In this alternative device 60 several prominent distinctive features are presented compared to the embodiments explained previously.

A first distinction is that two latch mechanisms 70 are provided at opposite sides of the slot, both latch mechanisms 70 being active for the same (five) tubular storage positions. In this regard referral is made to FIGS. 1-4 where the two latch mechanisms 20 each relate to a different group of storage positions in a single slot 5. By having two latch mechanisms 70 at opposite side of the same group of storage positions, a tubular (2*a-e*) can be securely held in a storage position.

As is shown each latch mechanism has its own independent drive 75 for the rotary latch member shaft 71, so that only upon operation of both drives 75 a tubular can be released. This embodiment may be applied if additional security is desired.

A second distinction is that here each latch mechanism 70 also allows for transverse motion of the latch members shaft 21 with respect to the slot 5, e.g. to allow to adjust the latch mechanism to the diameter of the tubulars.

Here each latch mechanism includes a pivotal shaft support structure 72 with a suitable actuator, e.g. hydraulic cylinder 72*a*, to move the latch members shaft 21 transverse to the slot 5. Of course other designs are also possible to obtain this effect. A transverse mobility of the shaft 21 can also be envisaged in the embodiments of FIGS. 1-5.

In this example both shafts 72 have transverse mobility and the pivotal shat support structures 72 are connected by a suitable linkage 73 or other transmission, so that a common actuator 72*a* effects transverse motion of both shafts 72 simultaneously.

The invention claimed is:

1. A tubulars storage device for storing a plurality of tubulars, said tubulars storage device comprising:

a slot having an opening at a front end thereof, said slot forming a path of displacement for tubulars allowing to place tubulars at respective storage positions distributed along the slot and/or removal of said tubulars from the slot, a rotary latch members shaft, which is mounted substantially parallel to the slot, a drive connected to the rotary latch members shaft, said drive being adapted to effect controlled angular rotation of the latch members shaft, a plurality of latch members which are mounted on the latch members shaft so as to rotate with the latch members shaft and are arranged at spaced apart locations along the latch members shaft, wherein said plurality of latch members include a front latch member having a smallest angular extension and a rear latch member having a largest angular extension as well as one or more intermediate latch members between said front and rear latch member, each of said intermediate latch members having a greater angular extension than the preceding latch member on the latch members shaft, wherein the drive is adapted to selectively bring the rotary latch members shaft in one of a number of distinct angular positions, said number corresponding to the number of latch members on the latch members shaft plus one, and wherein the angular extension of each of the latch members on the latch members shaft is chosen such that:

in a first angular position of the rotary latch members shaft all latch members on the shaft extend in the path of displacement of tubulars, thereby prohibiting displacement of the tubulars along the slot, in a second angular position only the front latch member is located out of said path of displacement thereby effectively unlocking the front latch member and allowing the passage of a tubular, in each subsequent angular position said front latch member remains located out of said path of displacement of the tubulars, and thus effectively unlocked, and a successive latch member is also located out of said path of displacement, and thus effectively unlocked, and in a final angular position of the shaft all latch members are located out of the path of displacement of the tubulars and thus effectively unlocked.

2. A tubulars storage device according to claim 1, wherein the tubular storage device includes spaced apart finger members that delimit the slot.

3. A tubulars storage device according to claim 1, wherein a finger members is arranged spaced apart from a latch members shaft with associated latch members, the slot being delimited there between.

4. A tubulars storage device according to claim 1, wherein two latch members shafts with associated latch members are provided spaced apart from one another, the slot being delimited there between.

5. A tubulars storage device according to claim 1, wherein the tubular storage device includes at least one finger member delimiting a side of the slot, the latch members shaft being held in a shaft support structure mounted on the finger member.

6. A tubulars storage device according to claim 3, wherein the shaft support structure supports the shaft between each pair of neighbouring latch members.

7. A tubulars storage device according to claim 1, wherein the device allows to rotate the latch members shaft from the final angular position directly to its first angular position so that all latch members are brought from their unlocked directly to their locked position.

8. A tubulars storage device according to claim 1, wherein two latch members shafts with associated latch members are provided, each at opposite sides of the slot.

9. A tubulars storage device according to claim 8, wherein the two latch members shafts with associated latch members are arranged to be active for the same tubular storage positions.

10. A tubulars storage device according to claim 1, wherein each latch member shaft is mounted for transverse motion of the latch members shaft with respect to the slot.

11. An oil and gas industry drilling structure including a tubulars storage device according to claim 1.

12. An oil and gas industry drilling structure including a tubulars storage device according to claim 2.

13. An oil and gas industry drilling structure including a tubulars storage device according to claim 3.

14. An oil and gas industry drilling structure including a tubulars storage device according to claim 4.

15. An oil and gas industry drilling structure including a tubulars storage device according to claim 5.

16. An oil and gas industry drilling structure including a tubulars storage device according to claim 6.

17. An oil and gas industry drilling structure including a tubulars storage device according to claim 7.

18. An oil and gas industry drilling structure including a tubulars storage device according to claim 8.

19. An oil and gas industry drilling structure including a tubulars storage device according to claim 9.

20. An oil and gas industry drilling structure including a tubulars storage device according to claim 10.

* * * * *